United States Patent [19]

Bamford et al.

[11] Patent Number: 4,847,456

[45] Date of Patent: Jul. 11, 1989

[54] VACUUM CIRCUIT INTERRUPTER WITH AXIAL MAGNETIC ARC TRANSFER MECHANISM

[75] Inventors: Allan J. Bamford, Big Flats; Paul O. Wayland, Montour Falls, both of N.Y.

[73] Assignee: Westinghouse Electric Corp., Pittsburgh, Pa.

[21] Appl. No.: 100,150

[22] Filed: Sep. 23, 1987

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,210,505 | 10/1965 | Porter | 200/144 B |
| 3,555,223 | 1/1971 | Robinson et al. | 200/144 B |
| 3,914,568 | 10/1975 | Crouch et al. | 200/144 B |
| 3,946,179 | 3/1976 | Murano et al. | 200/144 B |
| 3,980,850 | 9/1976 | Kimblin | 200/144 B |
| 4,052,577 | 10/1977 | Votta | 200/144 B |
| 4,260,864 | 4/1981 | Wayland | 200/144 B |
| 4,345,126 | 8/1982 | Cherry | 200/147 R |
| 4,401,868 | 8/1983 | Wootton | 200/144 B |
| 4,430,536 | 2/1984 | Kurosawa et al. | 200/144 B |
| 4,445,015 | 4/1984 | Zueckler | 200/144 B |
| 4,451,813 | 5/1984 | Hirose et al. | 337/17 |

*Primary Examiner*—Robert S. Macon

*Attorney, Agent, or Firm*—M. J. Moran

[57] ABSTRACT

A vacuum circuit interrupter characterized by an evacuated housing containing a pair of separable electrical contacts which can generate an arc when separated to an open position. An electromagnetic structure for diffusing the arc radially from between the electrical contacts to transfer contacts surrounding each electrical contacts and including an axial magnetic coil and including a cylindrical conductor surrounding a longitudinally movable electrode mounting one of the electrical contacts. The housing includes an end wall through which the electrode extends in a vacuum-tight and electrically insulated manner. The end wall having a high coefficient of electrical conductivity and having an annular portion extending outwardly from the end wall for good electrical contact with a bus conductor.

3 Claims, 2 Drawing Sheets

VACUUM CIRCUIT INTERRUPTER WITH AXIAL MAGNETIC ARC TRANSFER MECHANISM

BACKGROUND OF THE INVENTION

1. Technical Field:

This invention relates to vacuum circuit interrupters and more particularly to vacuum circuit interrupters with axial magnetic arc transfer mechanisms.

2. Description of the Invention:

A vacuum circuit interrupter is an evacuated container that encloses electrical contacts for carrying a load current in an electrical distribution system. When the contacts are separated, an arc usually occurs during initial moments of the separation. The arc occurs at high power and must be extinguished without damaging the interrupter in order to ensure repetitive operation.

Vacuum circuit interrupters of various types have been developed for preventing localized destruction arc burning damage to the surface contacts during interruption. Typical solutions to problems of dissipating an arc and minimizing damage to a vacuum interrupter are shown in prior art U.S. Pat. Nos. 3,670,129; 4,020,304; 4,079,217; 4,553,002; and 4,618,705. These patents disclose in a vacuum interrupter a magnetic field applied to disburse an arc from the contacts during interruption of a current.

As a result of an ongoing effort to further minimize damage incurred during arcing, an effort has been made to improve the transfer of current to the load terminal during arcing. An overall objective has been to reduce the electrical resistance paths between the movable contact and the outside of the interrupter.

SUMMARY OF THE INVENTION

It has been found in accordance with this invention that a vacuum circuit interrupter comprising an evacuated insulating housing having end walls, a circuit breaker structure within the housing and comprising first and second separable contacts operable between closed and open positions and conducive to forming an electric arc when opened; a first electrode supporting the first contact and a second electrode supporting the second contact, both electrodes extending through the end walls in a vacuum-tight manner, and with at least the first electrodes being out of electrical contact with a corresponding end wall; means for diffusing an arc away from the contacts and including for each contact an annular transfer contact and a transfer conductor, each transfer conductor extending from a transfer contact to a corresponding end wall; the end wall corresponding to the first electrode comprising an annular portion extending outwardly from the end wall and on the side opposite the contacts to enable good electrical contact with a bus conductor; the annular transfer contact comprising an axial magnetic coil to enable an arc between the first and second contacts to transfer radially outwardly to the annular transfer; the magnetic coil having an annular shape and the transfer conductor being tubular and encircling the first electrode; the end wall including an aperture and a copper disk inserted within the aperture and encircling the first electrode which disk includes the annular portion; the transfer conductor extending between the magnetic coil and the copper disk; mounting means provided for mounting the end plate on a bus conductor with the annular portion in good electrical contact with bus conductor; the first electrode extending through an aperture in the bus conductor and the mounting means including studs secured to the end wall and extending through the holes in the bus conductor; and conducting means provided between the first electrode and the bus conductor.

The advantage of the vacuum circuit interrupter of this invention is that it provides good electrical contact between the movable electrode and the fixed transfer ring such as a flexible conductor or a rolling contact.

DESCRIPTION OF THE PREFERRED EMBODIMENTS

Figure 1:
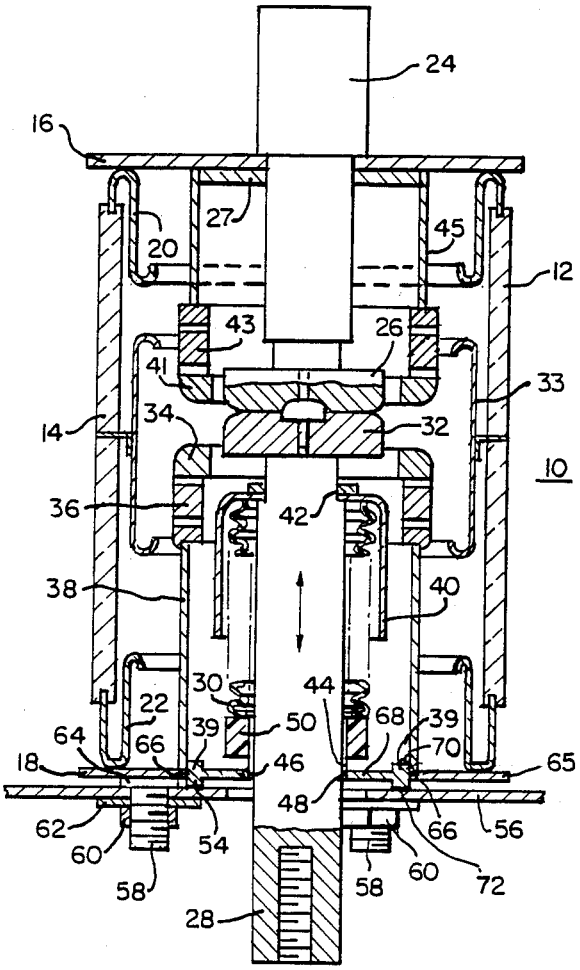
FIG. 1 is a representative view of a vacuum type circuit interrupter constructed in accordance with this invention.

As shown in FIG. 1 a vacuum-type circuit interrupter is generally indicated at 10 and it comprises a hermetically sealed, evacuated container or envelope 12, such as that generally shown in U.S. Pat. No. 4,260,864. The envelope 12 includes a cylindrical insulating member 14, opposed conductive end plates 16, 18, which are sealed to the ends of the cylindrical insulating body by annular seal means 20, 22. A conductive lead-in and contact support rod or first electrode 24 is sealed through end plate 16 and supports a fixed contact 26. A copper disc 27 is disposed against the undersurface of the end plate 16 where it is secured in place by a metallurgical bond, such as brazing, to the transfer cylinder 45 and the electrode 24. Another conductive lead-in and contact support rod or second electrode 28 is sealed in a movable fashion through the end plate 18 via bellows seal assembly 30. The contact support rod 28 supports a movable contact 32.

An annular transfer contact 34 is fixedly mounted around the movable contact 32. The transfer contact 34 is mounted on a magnetic coil 36 which in turn is supported on a cylindrical transfer conductor 38. The lower end of the conductor 38 is secured in place around a transfer ring 39 on the end plate 18. Likewise, an assembly of a transfer contact 41 and a magnetic coil 43, similar to the transfer contact 34 and the magnetic coil 36, is retained in place by a support 45.

The bellows 30 is part of a bellows assembly the upper end portion of which includes a shroud 40 which together with the upper end of the bellows is secured at an air-tight joint 42 to the upper end of the support rod 28. The lower end of the bellows assembly includes a mounting bracket 44, the lower end of which is secured at an air-tight joint 46 within a hole 48. The bellows assembly also includes an annular insulator 50 between the mounting bracket 44 and the bellows 30. The insulator prevents current flow through the thin metal bellows. The bellows assembly including the bellows 30 and the shroud 40 and the annular insulator 50 provide a hermetically sealed joint between the end plate 18 and the upper end of the support rod 28. Accordingly, the movable contact 32 is retractable from the stationary contact 26 to a position substantially within the transfer contact 34 when a fault current passes through the contacts 26, 32. An annular arc shield 33 surrounds the contacts 26, 32.

In accordance with this invention the end plate 18 is comprised of structurally strong material, such as stainless steel, having a high resistance material. The plate 18 has a central hole in which an insert 68 is disposed. The insert 68 includes the transfer ring 39 as well as an annular ring 54.

During normal operation with the contacts 26, 32 closed, current flows preferably from a line terminal through the support rod 24, the contacts 26, 32, and the support rod 28 in accordance with standard interrupter design. In a standard design, a load is typically connected to the support rod 28 by a flexible bus arrangement, or alternately by some form of sliding or rolling contact forming a single connection as required.

During a fault interruption an arc moves radially outwardly on the movable contact surface and transfers to the transfer contacts 34, 41. A large fraction of the fault current then flows through the axial magnetic coil 36 and through the transfer conductor 38 to the end plate 18 and through the annular ring 54 to a bus 56.

To assure good electrical contact, the bus 56 is secured tightly against the annular ring 54 by an assembly of spaced studs 58 (FIG. 2) which include nuts 60 and washers 62. The studs are metallurgically bonded at 64 to the end plate 18. In order to provide a low resistance path between the transfer conductor 38 and the bus 56, the insert 68 is comprised of a high conductivity material. However, to provide a satisfactory metallurgical bond 64 between the studs 58 and the end plate, an outer peripheral portion 65 of the end plate 18 may be comprised of stainless steel which is bonded at 66 to an insert 68 comprised of copper and including the hole 48 as well as the transfer ring 39 and the annular ring 54. Thus, the lower end of the copper transfer conductor 38 is secured at a brazed joint 70 to the transfer ring 39 and the inner periphery of the end plate 18.

As an alternative to the use of the stud assembly including the studs 58, the bolts 60 and the washer 62, the copper bus 56 could be secured by a brazed joint 72 to the annular ring 54. In this embodiment of the invention (FIG. 1) the interrupter is a three terminal device.

Figure 2:
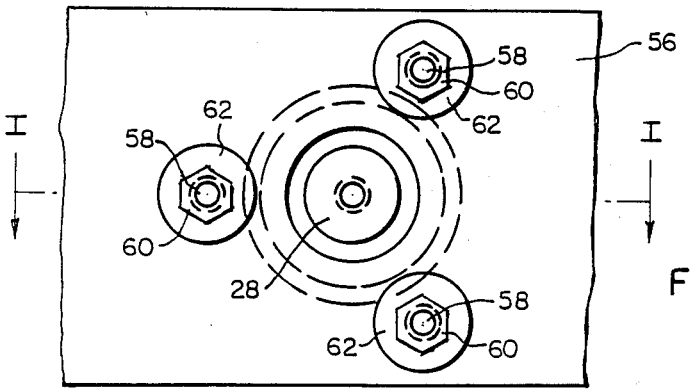
FIG. 2 is an end view taken on the line II—II of FIG. 1.
Figure 3:
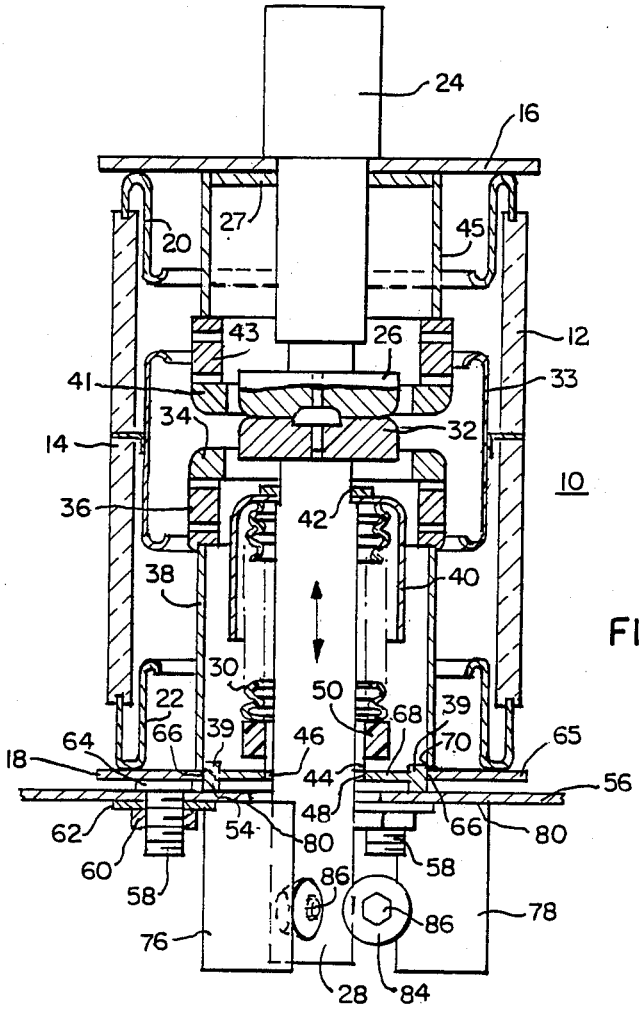
FIG. 3 is a vertical sectional view of another embodiment of the invention.
Figure 4:
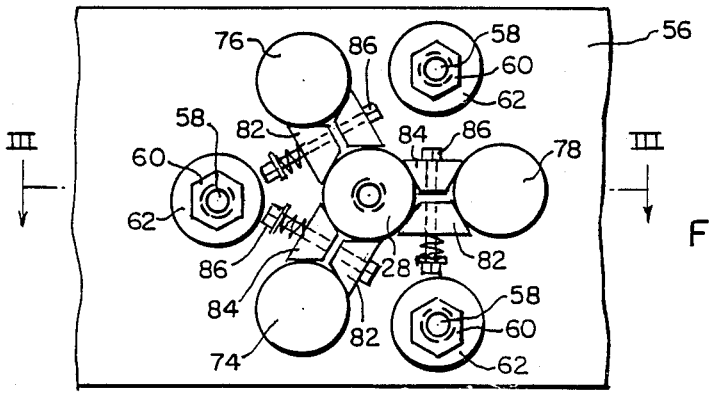
FIG. 4 is an end view taken on the line IV—IV of FIG. 3.

In another embodiment of the invention (FIGS. 3 and 4) the device may be a pseudo two terminal device in which similar numerals refer to similar parts as those shown in FIGS. 1 and 2. In this embodiment three posts 74, 76, 78 are metallurgically secured to the under surface of the bus 56, such as by brazed joints 80. Thus the three posts 74, 76, 78 are symmetrically disposed around the support rod 28. Between the post and each rod a pair of similar truncated roller conductors 82, 84 are mouned such as by a bolt and nut assembly 86 to provide a current path between the support rod 28 and the posts. Thus, current flowing down the movable support rod or electrode 28 is conducted through the roller conductors 82, 84 to the posts 74, 76, 78 and then to the bus 56 which is secured to the annular ring 54 by stud assemblies 58.

As an alternative to the roller conductors 82, 84 a flexible conductor may be provided between the support rod 28 and each of the posts.

In conclusion the device of this invention provides a structure by which an axial magnetic-arc transfer interrupter is provided such that external connections to the device can be accomplished in a simple and compact manner while providing an interrupter with an annular ring for enabling a two path current structure and which can be converted from a three to two terminal device.

What is claimed is:

1. A vacuum circuit interrupter comprising:

an evacuated insulating housing having end plates;

a circuit breaker structure within the housing and comprising first and second separable contacts operable between closed and open positions and conducive to forming an electric arc when opened;

a first electrode supporting the first contact and a second electrode supporting the second contact, both electrodes extending through the end plates in a vacuum-tight manner, and with at least one electrode being out of electrical contact with a corresponding end plate;

means for diffusing an arc away from the contacts and including for each contact an annular transfer contact and a transfer conductor, each transfer conductor extending from a transfer contact to a corresponding end plate;

the end plate corresponding to said one electrode comprising an annular portion extending longitudinally outwardly from said end plate and on the side opposite the contacts to enable good electrical contact with a bus conductor;

the annular transfer contact comprising an axial magnetic coil to enable an arc between the first and second contacts to transfer radially outwardly to the annular transfer contact;

the magnetic coil having an annular shape and the transfer conductor being tubular and encircling said one electrode;

the end plate including an aperture and an apertured insert of high electrical conductivity within the aperture and encircling said one electrode which insert includes the annular portion extending toward and in electrical contact with the bus conductor and forming a space between the end plate and the bus conductor; and the transfer conductor extending between the magnetic coil and the insert and in electrical contact with the insert.

2. The vacuum circuit interrupter of claim 1 in which the said one electrode extends through an aperture in the bus conductor and the mounting means includes studs secured to the end wall and extending through holes in bus conductor and with stud portions disposed in said space for good electrical contact with the bus conductor.

3. The vacuum circuit interrupter of claim 2 in which conducting means are provided between said one electrode and the bus conductor.

* * * * *